US006132259A

United States Patent [19]

Chapman et al.

[11] Patent Number: 6,132,259

[45] Date of Patent: Oct. 17, 2000

[54] JACKS FORMED BY DIE CASTING

[75] Inventors: James S. Chapman, Omaha; Jeffrey D. Nielson, Elkhorn, both of Nebr.; Ross J. Thompson, Bridgewater, N.J.; William C. Clark, Lee's Summit, Mo.; Robert R. Douglas, Omaha, Nebr.; David S. Devincentis, Flanders, N.J.

[73] Assignee: Lucent Technologies Inc., Murray Hill, N.J.

[21] Appl. No.: 09/163,243

[22] Filed: Sep. 30, 1998

[51] Int. Cl.[7] ..... H01R 24/04

[52] U.S. Cl. ..... 439/668; 439/668; 439/669

[58] Field of Search ..... 439/668, 669, 439/540.1; 411/520, 525, 526, 527, 353

[56] References Cited

U.S. PATENT DOCUMENTS

| | | | |
|---|---|---|---|
| 2,382,520 | 8/1945 | Tinnerman | 411/527 |
| 2,709,390 | 5/1955 | Smith | 411/520 |
| 2,783,674 | 3/1957 | Becker | 411/520 |
| 3,822,415 | 7/1974 | Deitch | 439/669 |
| 4,368,941 | 1/1983 | Martin | 439/669 |
| 4,588,251 | 5/1986 | Newton | 439/668 |
| 4,861,281 | 8/1989 | Warner | 439/540 |
| 5,145,416 | 9/1992 | Cruise et al. | 439/668 |
| 5,803,692 | 9/1998 | Postadan | 411/526 |
| 5,833,422 | 11/1998 | Haga et al. | 411/526 |

*Primary Examiner*—Gary F. Paumen
*Assistant Examiner*—Tho D. Ta
*Attorney, Agent, or Firm*—Darby & Darby

[57] ABSTRACT

A jack assembly is provided in which the central body of the assembly includes integrally cast posts for aligning and securing follower springs, wiper springs and spacers. To assemble the jack, the follower springs, wiper springs and spacers are stacked onto the posts and then secured with a pushnut that engages the posts with a friction fit, avoiding separation from the central body.

17 Claims, 5 Drawing Sheets

JACKS FORMED BY DIE CASTING

FIELD OF THE INVENTION

The invention relates generally to a jack assembly used in electrical panels for connecting circuits. More specifically, the invention relates to a jack having a central component that is die cast to reduce the number of parts and the labor required to manufacture the jack.

BACKGROUND OF THE INVENTION

With the recent explosion in the number of computer networks, cable television networks, the internet, and other digital networks, the need for interconnection units has grown similarly. A common unit in use is a jack panel that is part of manual digital cross-connect (DSX) frame systems used for cross-connection, temporary patching, and monitoring of digital circuits conforming to the DS-1 or DS-1C transmission standards. An example of such a jack panel is the BANTAM DSX-1/1C Jack Panel. A standard panel contains 168 jacks, which can be interconnected in literally thousands of combinations.

The current jacks used in the panels have anywhere from 17 to 21 parts per jack that are held together with machine screws and nuts. These jacks require significant hand assembly. Both of these features make the current jacks costly and inefficient to manufacture.

Manufacture of jacks of past and current designs would be difficult to automate as they involve the assembly of posts, screws and nuts to secure stacks of springs and spacers. For example, U.S. Pat. No. 4,861,281 to Warner discloses a jack in which the posts, springs, spacers and nuts must be hand assembled. With reference generally to FIG. 5 of the '281 patent, the prior art shows a jack unit having a case frame structure 42 including support beams 60 and 64. The support beams have holes 62 and 66 through which bolts 80 are inserted and extend for securing the spacers and springs. As seen in FIG. 2 of the '281 patent, the various springs (e.g., 72, 76) and spacers 78 are mounted on the bolts in order, and then they are secured in place by nuts placed on the ends of the bolts.

Before the nuts are tightened on the bolts in the '281 patent, the various springs and spacers are not secured to the bolts, nor are the bolts secured to the support beams. This makes assembly difficult. The '281 patent disclosure relies on the multiple support beams to avoid any twisting or loosening of the various components during use. However, the rigidity and integrity of the overall unit is solely dependent on the nuts and bolts being tightly secured and having a tight clearance with the holes in the support beams.

SUMMARY OF THE INVENTION

In view of the foregoing deficiencies of the prior art, it is an object of the present invention to provide an improved jack assembly.

It is another object of the present invention to provide a jack assembly with a cast post to provide an assembly fixture to position and retain the springs and spacers during assembly.

It is a further object of the present invention to provide a jack whose assembly can be easily automated.

It is yet another object of the present invention to provide a jack assembly in which the springs and spacers are held on the posts by pushnuts for ease of assembly.

It is a still further object of the present invention to provide a jack assembly in which dual posts provide resistance to rotation during mechanical and thermal cycling, increasing the reliability of the assembly.

It is a yet further object of the present invention to provide a dual pushnut for securing the springs and spacers to the dual cast posts of the jack assembly.

It is still another object of the present invention to provide a jack assembly that is formed with fewer unique parts to reduce automation, design and inventory costs and that may be manufactured at a lower cost with overall higher quality, consistency and reliability.

In an illustrative embodiment of the present invention, a jack assembly is provided in which the central body of the assembly includes integrally cast posts for aligning and securing the jack springs and spacers. To assemble the jack, the springs and spacers are stacked onto the posts and then secured with a pushnut that engages the posts with a friction fit, avoiding separation from the central body.

BRIEF DESCRIPTION OF THE DRAWINGS

The foregoing and other objects and advantages will become apparent to those skilled in the art upon reading the following detailed description of the preferred embodiment in conjunction with a review of the appended drawings, in which.

DETAILED DESCRIPTION OF THE PREFERRED EMBODIMENT

Figure 1:
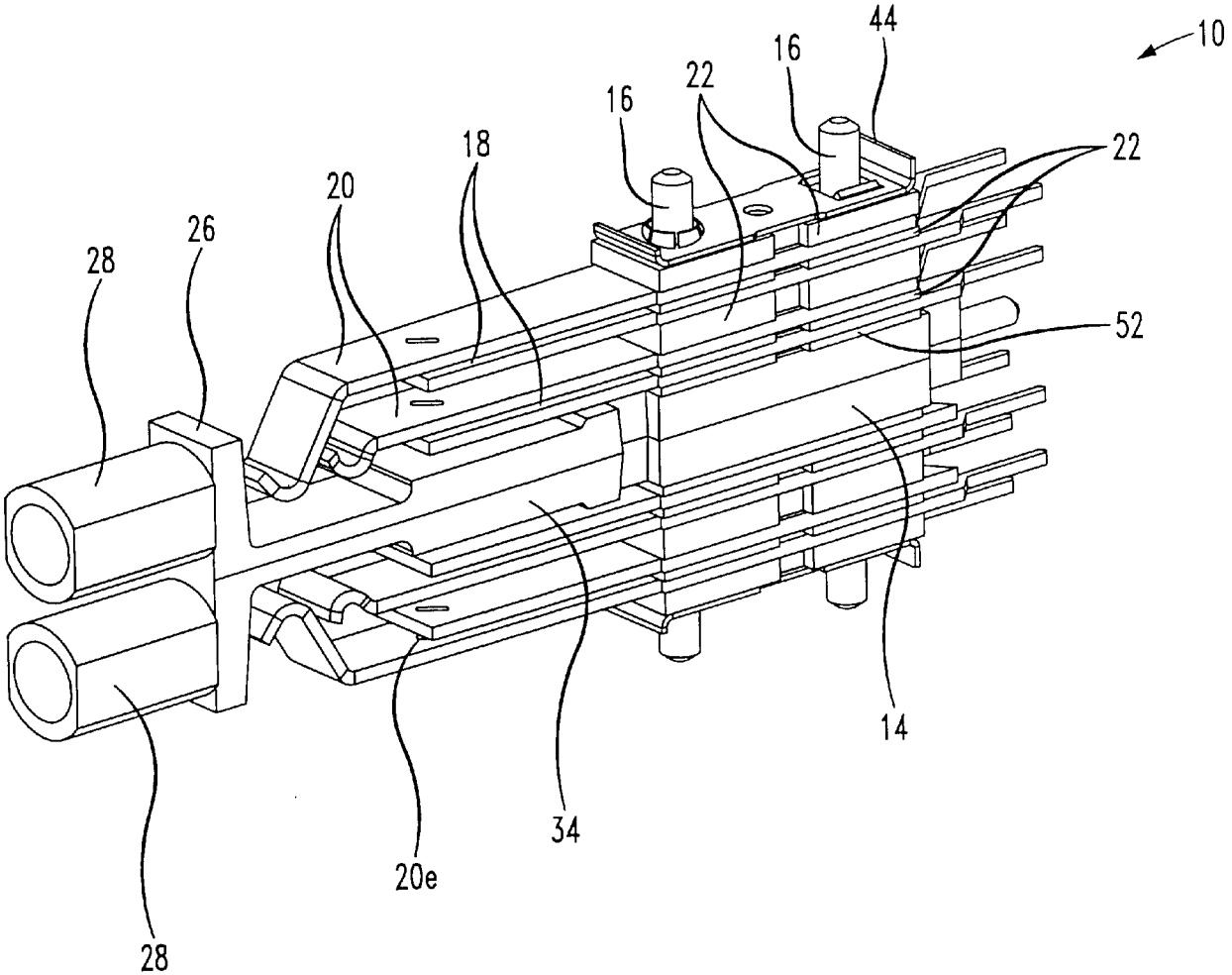
FIG. 1 is a perspective view of a jack assembly according to a preferred embodiment of the invention.

Referring now to FIG. 1, a jack assembly 10 according to the preferred embodiment of the invention is shown. In overview, the jack assembly 10 is comprised of a central body 12 having an elongated midsection 14. Four posts 16 extend from the midsection 14 to support the follower springs 18, wiper springs 20, and spacers 22, 52 that make up the functional portion of the jack assembly 10. A pushnut 44 is mounted on top of the stack of springs 18, wiper springs 20, and spacers 22, 52 to retain them on the posts 16.

Two posts 16 preferably extend from each of the top and bottom surfaces of the midsection 14. According to the invention, the four posts 16 are cast integrally with the central body 12. For the purposes of this specification, the posts 16 extending above and below the midsection are considered to define a vertical plane. It is to be understood that the jack assembly 10 can easily be mounted with the posts 16 horizontal or at any angle with respect to horizontal, but for reference purposes, the posts 16 define a vertical plane. It is also not necessary that all of the posts 16 lie in a plane, although it is preferred that each pair of posts 16 extending from the same side of the midsection 14 be generally parallel. There also may be any number of posts 16, although it is preferred that there be at least two.

Various follower springs 18, wiper springs 20, and spacers 22 are interleaved on the posts 16. Each of the follower springs 18, wiper springs 20, and spacers 22, 52 includes at least two apertures 24 to receive the posts 16 on which they are mounted. The spacers 22 and pylon spacers 52 serve to position the follower springs 18 and wiper springs 20 and to electrically insulate the follower spring 18 and wiper spring 20 pairs from each other and from the central body 12.

The central body 12 of the assembly also includes a front flange 26 with barrels 28 for receiving the plugs (not shown) that are inserted into the jack assembly 10 to make a connection with the wiper springs 20. The front flange 26 is preferably mounted along the vertical axis, perpendicular to the midsection 14 and parallel to the posts 16. The front flange 26 may advantageously be cast integrally with the midsection 14 of the central body 12, or may be attached during assembly without significant detriment and without departing from the invention.

The midsection 14 of the central body 12 is generally shaped as a rectangular prism. This provides a smooth, planar top and bottom surface 30, 32 for the first follower spring 18 or spacer 22 mounted on the posts 16. If these surfaces 30, 32 of the midsection 14 were not planar, there could be instability in the stack of follower springs 18, wiper springs 20, and spacers 22, 52 when mounted. The midsection 14 of the central body 12 extends from the area in which the posts are attached to a preferably narrowed transition area 34 where it is attached to the front panel 26. The narrowed transition area 34 of the central body 12 allows the wiper springs 20 to deflect when plugs are inserted into the jacks without hitting the central body. This also provides clearance for the follower springs 18 and wiper springs 20 to be biased toward the central body. The plug can then move the follower springs 18 and wiper springs 20 away from the central body, causing firm continuous contact with the wiper springs 20.

Figure 2:
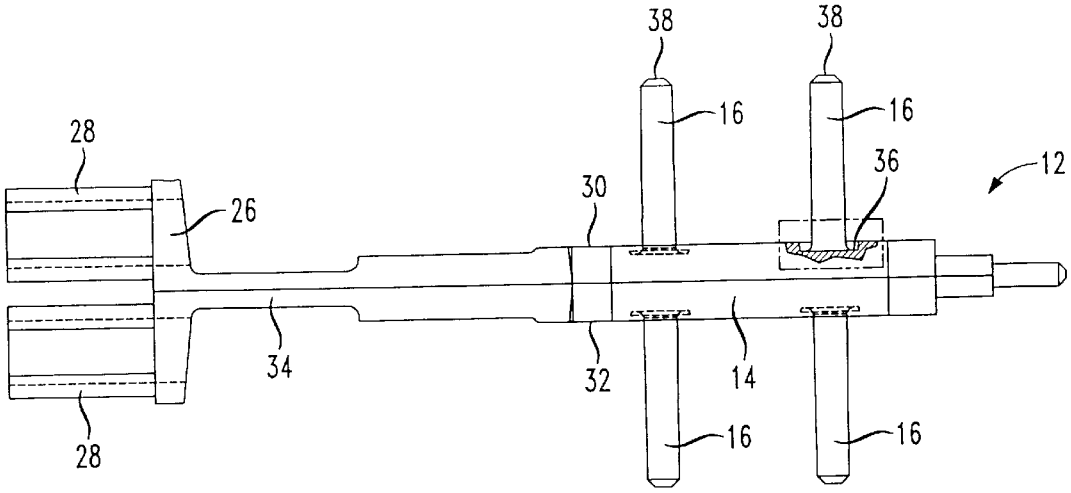
FIG. 2 is a side view of a central body of a jack assembly according to a preferred embodiment of the invention.
Figure 3:
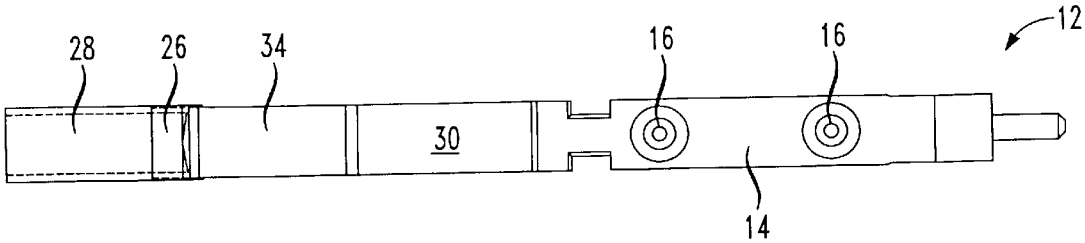
FIG. 3 is a top view of a central body of a jack assembly according to a preferred embodiment of the invention.
Figure 4:
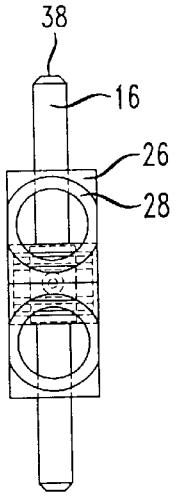
FIG. 4 is an end view of a central body of a jack assembly according to a preferred embodiment of the invention.
Figure 5:
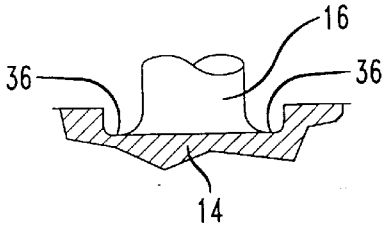
FIG. 5 is a detail view of the juncture between a post and the midsection of a central body of a jack assembly according to a preferred embodiment of the invention.

The posts 16 are cast as one unit with the midsection 14. Each post has a conical shape which decreases in diameter slightly from the midsection 14 to the end of each post 16. Referring now to FIGS. 2 and 5, at the attachment point between the midsection 14 and the post 16, a small depression 36 is cast into the midsection 14 to ensure that the first spring 18 or spacer 52 mounted on the posts 16 will rest flush against the midsection 14. The small depression also relieves any stress that may concentrate at the interface of posts 16 and midsection 14. The posts 16 preferably have a nearly constant diameter over a majority of their length so that components at a higher elevation in the stack will have only slightly more misalignment with respect to the posts than do those closer to the central body 12. Some misalignment in a plane parallel to the midsection is tolerable, so long as it does not interfere with the functioning of the follower springs 18 and wiper springs 20 when a plug is inserted. All wiper springs 20, must of course remain aligned sufficiently to establish a connection with a plug upon insertion in jacks 28. The tip 38 of each post 16 is preferably rounded or chamfered to assist in guiding the follower springs 18, wiper springs 20, and spacers 22, 52 onto the posts 16. This improves the ease of assembly and improves the possibility of automating the assembly of the jacks.

Figure 6:
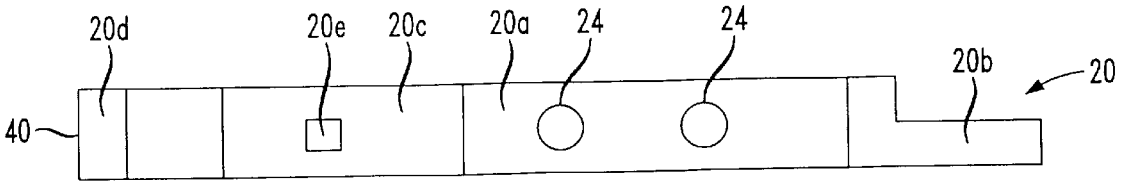
FIG. 6 is a top view of a wiper spring according to a preferred embodiment of the invention.

The wiper springs 20 are preferably stamped from sheet metal. Referring now to FIG. 6, each wiper spring 20 is a single piece of metal that can be considered to have five portions, a base portion 20*a* that will make up part of the stack of follower springs 18 and spacers 22, 25, the connection portion 20*b*, extending away from the front flange 26 and including some formation for connecting the wiper spring 20 to the remaining circuitry of the panel (not shown); the spring contact portion 20*c*, which extends from the stack toward the front flange 26 and includes a contact 20*e*; and the portion 20*d* that wipes against the plug. The distal end 40 of the contact portion 20*d* is curved to allow the plug to slide by it and to provide a single firm contact point with the plug. The base portion 20*a* includes the two holes 24 to receive the posts. Preferably, the two holes 24 are sized, chamfered or radiused to be able to easily accept the diameter of the sleeves 56 of the pylon spacer 52 while maintaining alignment in the stack.

Figure 10:
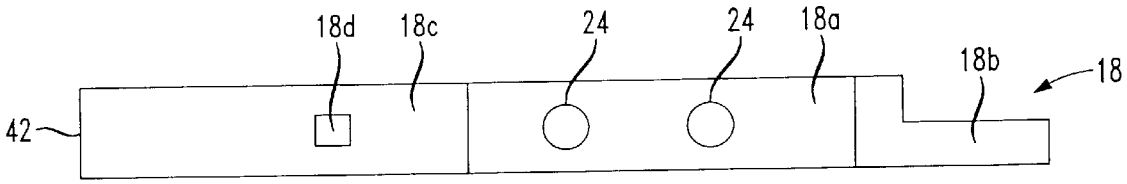
FIG. 10 is a top view of a follower spring according to a preferred embodiment of the invention.

Referring now to FIG. 10, the follower springs 18 are also stamped as a single piece of sheet metal and have four main portions: the base portion 18*a*, similar to the base portion 20*a* of the contacts, the connection portion 18*b*, similar to 20*b*; and the contact portion 18*c*, which includes contact 18*d* similar to 20*c* and 20*e*, and which extends from the base portion 18*a* toward the front flange 26. The thickness of spacer 22 together with the height of contacts 18*d* and 20*e* form a conductive path when assembled. The conductive path is opened when a plug is inserted. The base portion 18*a* of the springs includes two holes 24 to receive the posts. Preferably, the two holes are sized to be able to easily accept the diameter of the sleeves 56.

Figure 11:
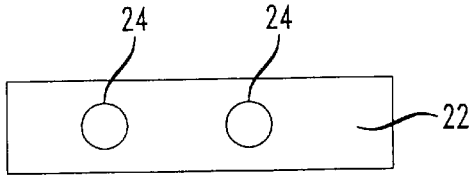
FIG. 11 is a top view of a spacer according to a preferred embodiment of the invention.

Referring now to FIG. 11, the spacers 22 are preferably formed as rectangular pieces, all being sized to reduce the number of unique parts needed in a jack assembly. The size of the spacers 22 defines the size of the stack. The spacers 22 are preferably long enough in the direction of the midsection 14 to provide a stable platform for the follower springs 18 and wiper springs 20 against torque due to the insertion of jacks. The spacers 18 also include two holes 24 to receive the posts 16. Preferably, the two holes are sized to be easily able to accept the diameter of the sleeves 56.

Figure 7:
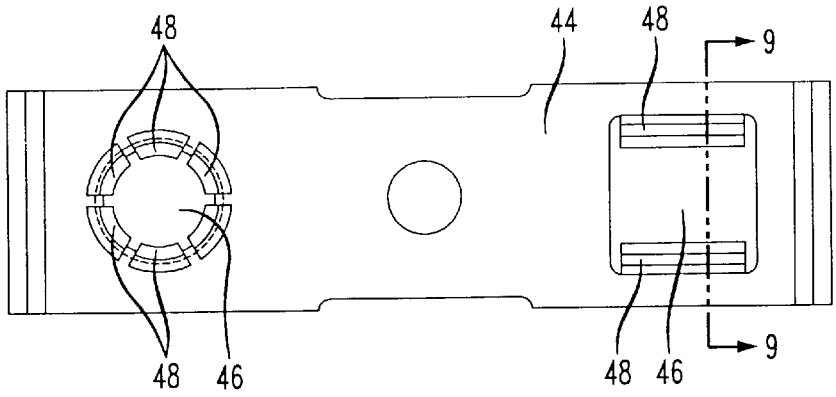
FIG. 7 is a top view of a dual pushnut according to a preferred embodiment of the invention.
Figure 8:
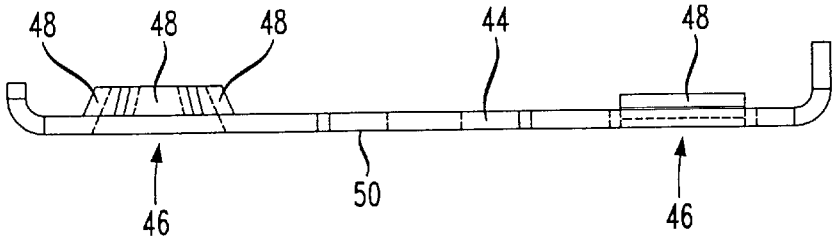
FIG. 8 is a side view of a dual pushnut according to a preferred embodiment of the invention.
Figure 9:
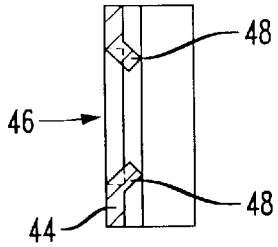
FIG. 9 is a cross-section view of a dual pushnut taken along the line 9—9 of FIG. 7.

Referring now to FIGS. 7–9, the pushnut 44 is preferably stamped from sheet metal, which may be a different material than that used to form the follower springs 18 and wiper springs 20, as long as that chosen material has adequate thickness and material properties to function as the pushnut. The pushnut 44 is formed with two holes 46 to receive the posts 16. Both holes 46, however, are stamped with tabs 48 bent slightly out of the plane of the pushnut 44 toward the same side of the pushnut 44. The tabs 48 are sized and angled so that when the pushnut 44 is mounted on the posts 16, the posts 16 will slightly expand the tabs 48 in elastic deformation. The pushnut 44 is mounted onto the posts 16 with the tabs 48 facing away from the midsection 14. The opposite surface 50 of the pushnut 44 is therefore flat and will lie against the uppermost spacer in the stack. The tabs 48 will then maintain sufficient pressure against the posts 16 so that friction will prevent the pushnut 44 from moving away from the midsection 14. Because of the angle of the tabs 48, the pushnut 44 will resist torque when the contacts 20 and springs 18 are loaded by an inserted plug. Torque will only increase the pressure of the tabs 48 on the post 16, increasing the friction and preventing movement.

It is preferred that the configuration of tabs 48 on the two holes 46 be different. As seen in FIG. 7, the hole 46 that will receive the post 16 closer to the front panel 26 is preferably formed with several tabs forming an annulus around the hole 46. This provides maximum contact between the tabs and the post 16. The tabs around this hole will experience most of the torque produced by the springs 18 and contacts 20 being moved at their ends 40, 42 by a plug. The hole 46 away from the front panel 26 preferably has fewer tabs 48, such as the two shown in FIG. 7. These tabs 48 are sufficient to resist movement and the minimal torque that will be experienced at that hole 46.

Figure 12:
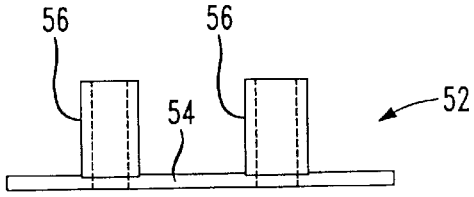
FIG. 12 is a top view of a pylon spacer according to a preferred embodiment of the invention.
Figure 13:
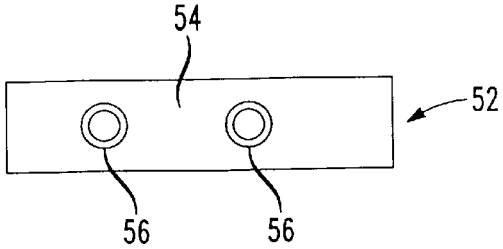
FIG. 13 is a side view of a pylon spacer according to a preferred embodiment of the invention.

Referring now to FIGS. 12 and 13, the pylon spacers 52 each include a base 54 and two sleeves 56. The sleeves are sized and spaced apart to fit onto the posts and rest so that the base 54 is flush with the midsection 14. The sleeves prevent contact between the posts 16 and the follower springs 18 or wiper springs 20.

The central body 12 including the posts 16 is preferably cast from a zinc-aluminum alloy. Zinc-aluminum is preferred because it is easily cast, relatively inexpensive, yet durable and rigid enough to withstand both thermal and physical stresses from the cycling of tension on the follower springs 18 and wiper springs 20 during use. Many other substances, including but not limited to other metals, plastics, composites, and ceramics will work similarly, with the performance and costs varying depending on the characteristics of the material being used. The follower springs 18 and wiper springs 20 are preferably stamped from a conductive sheet metal, such as an alloy of copper. Any conductive substance with sufficient characteristics in terms of conductivity, elasticity, and durability will work similarly. The spacers 22 and pylon spacers 52 are preferably formed of a non-conductive plastic, such as polybutylene terephthalate although many non-conductive materials will work similarly.

Assembling the jack is significantly improved compared to the prior art. Once the central body 12 has been cast and the follower springs 18, wiper springs 20, and spacers 22, 52 have been formed, assembly is accomplished as follows: the pylon spacers 52 are placed on the posts 16, followed by the follower springs 18, spacers 22 and wiper springs 20 in the desired order. Once the entire stack has been placed onto the posts 16, a pushnut 44 is simply placed onto the stack and pushed down with sufficient force to ensure all components of the entire stack are flush with each other and the pushnut 44 will hold its place. The assembly is then complete. It is easily seen that this process can be automated. The process of the present invention eliminates the prior art steps of threading a bolt through holes in a body; holding the bolt in place while mounting the follower springs, wiper springs and spacers; having a nut catch the thread of the bolt; and then rotating the nut while holding the other end of the bolt firm to screw the bolt down tightly on the stack.

Thus it can be seen that the objects and advantages of the invention are met by the present improved jack assembly, both in terms of assembly and in function. It will be understood by those skilled in the art that variations may be made from the preferred embodiment without departing from the spirit of the invention. It is also to be understood the foregoing embodiments have been shown and described for the purposes of illustration and not for the purpose of limitation, the invention being only limited by the claims, as follows:

What is claimed is:

1. A jack assembly, comprising:

a central body having a midsection and at least one conical post, said at least one conical post being formed as a one-piece construction with said midsection and having a proximal base and a distal tip, each conical post decreases in diameter from said midsection to said distal tip;

at least one spring mounted on said at least one conical post, said at least one spring having a first hole for receiving said at least one conical post; and a pushnut mounted on said at least one conical post, said at least one spring being between said pushnut and said midsection, said pushnut resisting movement in a distal direction along said at least one conical post.

2. A jack assembly as in claim 1, further comprising a second conical post formed as a one-piece construction with said midsection and extending parallel to said at least one conical post, said at least one spring also having a second hole for receiving said second conical post, said pushnut having two holes for receiving said at least one conical post and said second conical post, respectively.

3. A jack assembly as in claim 2, further comprising a pylon spacer including a base and two sleeves, said sleeves being mounted on said at least one conical post and said second conical post, said base being adjacent to said midsection, said first and second holes in said spring receiving said sleeves.

4. A jack assembly as in claim 2, further comprising at least one spacer on said at least one conical post and said second conical post between said midsection and said at least one spring, said at least one spacer being non-conductive and including two holes for receiving said at least one conical post and said second conical post, respectively.

5. A jack assembly as in claim 4, wherein said pushnut is generally planar and includes a tab adjacent at least one of said two holes of said push nut, said tab being struck out of the plane of said pushnut away from midsection, said tab engaging at least one of said at least one conical post and said second conical post and resisting movement of said pushnut away from said midsection.

6. A jack assembly as in claim 5, wherein a depression is cast in said midsection at each point of attachment between each of said at least one conical post and said second conical post and said mid section.

7. A jack assembly as in claim 5, wherein said pushnut further includes at least one tab adjacent the other of said at least one of said two holes of said pushnut.

8. A jack assembly as in claim 7, wherein said central body is formed from cast zinc-aluminum.

9. A jack assembly as in claim 7, wherein the number of tabs at each of said two holes of said pushnut is not equal.

10. A jack assembly as in claim 7, wherein one of said two holes of said pushnut is circular having a first number of tabs surrounding one of said two holes of said pushnut, and another hole of said two holes of said pushnut is rectangular having a tab extending from at least two sides of said another hole of said two holes of said pushnut.

11. A jack assembly as in claim 2, further comprising said at least one conical post and said second conical post extending in a first direction from said midsection and another two conical posts extending in a second direction from said midsection.

12. A jack assembly as in claim 11, wherein said first and second directions are parallel and opposite to each other.

13. A method of assembling a jack, comprising the steps of:

forming a central body having a midsection and at least one conical post integral therewith, said at least one conical post having a proximal base and a distal tip, each conical post decreases in diameter from said midsection to said distal tip;

mounting a spring having a first hole to receive said at least one conical post onto said at least one conical post from said distal tip toward said proximal base; and mounting a pushnut having a first hole to receive said at least one conical post onto said at least one conical post with force toward said midsection to substantially prevent movement of said spring toward said distal tip.

14. A method of assembling a jack as in claim 13, further comprising the step of:

mounting a spacer having a first hole to receive said at least one conical post onto said at least one conical post from said distal tip toward said proximal base.

15. A method of assembling a jack as in claim 14, wherein said step of forming further comprises a second conical post integral with said midsection, said spring, said spacer, and said pushnut also further comprising a second hole for receiving said second conical post.

16. A method of assembling a jack as in claim 15, wherein said step of forming further comprises forming said at least one conical post and said second conical post substantially perpendicular to said midsection.

17. A method of assembling a jack as in claim 16, wherein said pushnut further comprises a tab at said at least one of said first hole and said second hole of said pushnut for frictionally engaging one of said at least one conical post and said second conical post.

* * * * *